United States Patent [19]

Golembeck

[11] 4,161,046

[45] Jul. 17, 1979

[54] COIL SPRING ASSEMBLY

[75] Inventor: Gerald A. Golembeck, Lake Elmo, Minn.

[73] Assignee: The United States Bedding Company, St. Paul, Minn.

[21] Appl. No.: 904,396

[22] Filed: May 10, 1978

[51] Int. Cl.[2] ..... A47C 23/04

[52] U.S. Cl. ..... 5/248; 5/256; 5/464; 5/DIG. 2

[58] Field of Search ..... 5/248, 256, 329, 351

[56] References Cited

U.S. PATENT DOCUMENTS

| | | | |
|---|---|---|---|
| 2,192,463 | 3/1940 | Wesley | 5/351 |
| 2,773,270 | 12/1956 | Royelle | 5/351 |
| 3,626,523 | 12/1971 | Robins | 5/351 |
| 3,981,034 | 9/1976 | MacMorran et al. | 5/351 |
| 4,052,760 | 11/1977 | Golembeck | 5/256 |

*Primary Examiner*—Casmir A. Nunberg

*Attorney, Agent, or Firm*—McDougall, Hersh & Scott

[57] ABSTRACT

A coil spring assembly for mattresses and box springs in which the coil springs are arranged in lengthwise and crosswise rows in the assembly with the outermost coil springs in each of the rows and in the middle rows extending lengthwise and crosswise of the spring assembly being formed of coil springs of greater firmness than the coil springs immediately adjacent the outermost rows and the middle rows but in which the number of rows formed of coil springs of greater firmness is at least equal to if not greater than the number of rows of coil springs of less firmness.

1 Claim, 3 Drawing Figures

X = 9½ GA.-COIL
O = 10½ GA.-COIL

FULL SIZE (9X9) 57 – 9½ GA.-COILS
24 – 10½ GA.-COILS

FULL KING SIZE (9X10) 66 – 9½ GA.COILS
24 – 10½ GA.COILS

QUEEN SIZE (10X10) 76 – 9½ GA.COILS
24 – 10½ GA.COILS

COIL SPRING ASSEMBLY

This invention relates to spring assemblies for mattresses and box springs.

Spring assemblies used in mattresses and box springs have been subject to failure because of premature sag whereby the comfort factor falls rapidly and the mattresses or box springs become unfit for use.

The art has sought to firm up the edges of box spring assemblies by the use of various types of edge supports for the edge walls. These comprise additional elements which tend to complicate the assembly and increase the cost without the complete elimination of premature sag.

In my previously issued U.S. Pat. No. 4,052,760, description is made of a coil spring assembly for mattresses and box springs in which the coil spring assembly is formed of a plurality of coil springs arranged in lengthwise and crosswise rows with the outermost coil springs in each of the lengthwise and crosswise rows and in the middle rows extending lengthwise in the spring assembly having greater firmness than the coil springs in between, and with the number of lengthwise rows of coil springs of greater firmness constituting at least half of the lengthwise rows of coil springs in the spring assembly. While the described assembly of coil springs provides for increased comfort of the mattress or box spring and greater firmness without the need for additional stiffness or supports, it has been found there is still a tendency to sag towards the middle, especially when a spring or mattress is used in a bed occupied by two or more people. This leads to discomfort as well as interference with the sleep or rest of the occupants.

It has been found that this deficiency can be overcome by construction of the coil spring assembly in the manner described in the aforementioned patent but with the modification to include coil springs of greater stiffness in the middle crosswise extending rows as well as in the lengthwise extending rows of the spring assembly, thereby to provide for greater support between the occupants as well as across the midsection of the occupants for better support, without sag in between. Thus the spring assembly defines two sleeping zones separated in the same assembly, and it is an object of this invention to provide a spring assembly of the type described characterized by improved comfort and support.

Figure 1:
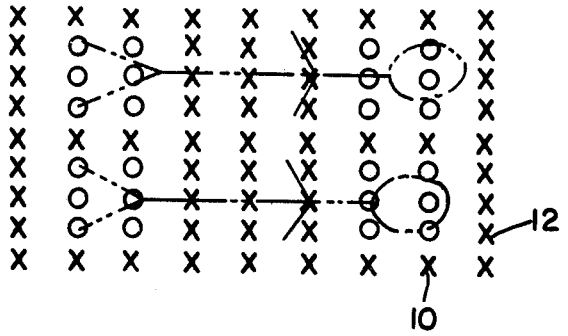
Figure 2:
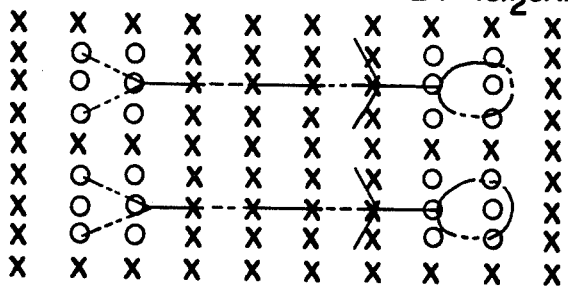
Figure 3:
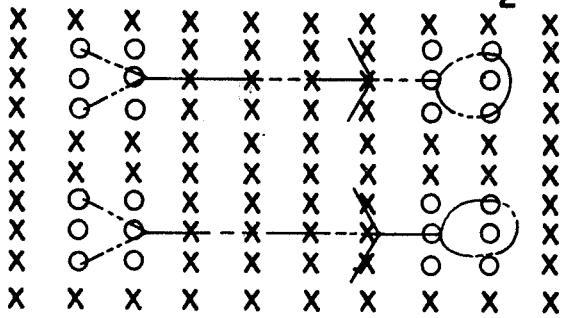

These and other objects and advantages of this invention will hereinafter appear and for purposes of illustration, but not of limitation, embodiments of the invention are shown in the accompanying drawings in which FIG. 1 is a schematic illustration of the arrangement of the coil springs in a spring assembly embodying the features of this invention for a full size double bed, FIG. 2 is a view similar to that of FIG. 1 showing the arrangement of the coil springs for a king size bed, and FIG. 3 shows the arrangement of coil springs for a queen size bed.

Briefly described, a coil spring assembly embodying the features of this invention is fabricated of a plurality of coil springs arranged in a plurality of lengthwise and crosswise extending rows 10 and 12 respectively, with the outermost coil springs in the lengthwise and crosswise rows and in the middle rows extending lengthwise and crosswise of the spring assembly, having greater firmness than the coil springs in between, with the number of lengthwise rows of coil springs of greater firmness making up at least half of the lengthwise rows of the coil springs in the spring assembly.

The concept described above will now be illustrated with reference to the arrangement of the coil springs in spring assemblies for double, king size and queen size beds, using two species of coil springs, one of which is identified by the letter "X" formed for example of 9½ gauge spring wire, in which a single coil spring requires 13 pounds of load for a one inch axial compression. The other species is identified by the letter "O" formed of 10½ gauge spring wire in which a single coil spring requires a load of 8 pounds for a one inch axial compression.

FIG. 1 illustrates the coil spring arrangement in a spring assembly for a full size bed. The coils are arranged in lengthwise and crosswise extending rows 10 and 12 respectively, with nine rows extending in the lengthwise and 9 rows extending in the crosswise direction. The outermost coil springs in each of the rows are of the firmer coil springs X. The coil springs in the three middle lengthwise rows and in the middle crosswise row are also of the firmer coil springs X, while the remainder of the coil springs in the two lengthwise rows immediately adjacent the outermost rows are of lesser firmness, as identified by the letter O. Thus the spring assembly is formed of five lengthwise rows of coil springs of greater stiffness and four rows of springs of lesser stiffness, except for the outermost coil springs in each of the rows and the coil springs in the middle crosswise row.

In FIG. 2, illustration is made of a spring assembly for a full king size bed having the coil springs arranged in ten lengthwise rows and nine crosswise rows. Again, the outermost coil springs in each of the lengthwise rows and crosswise rows are of coil springs of greater firmness X. The four middle rows extending in the lengthwise direction and the middle row extending in the crosswise direction make use of the species of coil springs having greater firmness X, while the two lengthwise rows extending immediately adjacent the outermost rows are formed of coil springs of less firmness O, except for the outermost coil springs in the rows and the coil springs making up the middle crosswise extending row.

In FIG. 3, illustration is made of the coil spring assembly for use with a queen size bed having coil springs arranged in ten lengthwise rows and ten crosswise rows. The outermost coil springs in each of the lengthwise and crosswise rows are of the coil springs of greater firmness X. The four middle rows extending in the lengthwise direction are of the species of coil springs of greater firmness X and the two middle rows extending in the crosswise direction are of the coil springs having the greater firmness X. The remainder of the coil springs in between are made up of coil springs of lesser firmness O. This adds up to six lengthwise extending rows and four crosswise extending rows of firmer coil springs.

The invention is not restricted to coil springs of a particular size, gauge or firmness, except that the concepts of this invention depend upon the combination of firm and not so firm coil springs in the one assembly, arranged as described. However, for increased comfort as well as ease of assembly, it is desirable to make use of coil springs in each assembly in which the coil springs are of the same size, even though they differ in gauge and stiffness as between the two sets of coil springs used in the assembly.

T1 complete the spring assembly, the terminal coils of the outermost coil springs are connected to upper and lower border wires, as by means of helical tie wires or clips. The coil springs are interconnected one to another in the lengthwise and crosswise rows, in the conventional manner, such as by helical tie wires, by metal or plastic clips which interconnect the terminal coils of the adjacent coil springs, by tie wires which extend alongside the terminal coils of the coil spring to interconnect the coil springs, or by locating the coils in pockets provided by a fabric whereby the coil springs are maintained in the desirable arrangement.

Thereafter, in forming a mattress, the coil spring assembly is covered with a cushioning layer, mat and/or grid and then enclosed by ticking and/or a mattress cover.

The spring assemblies of this invention provide improved comfort and support as well as prevention of sag thereby to increase the useful life of the mattress or box spring. A mattress characterized by greater firmness is obtained without the need to fabricate the spring assembly entirely out of more expensive and firmer varieties of coil springs.

It will be understood that changes may be made in the details of construction, arrangement and operation, without departing from the spirit of the invention, especially as defined in the following claim.

I claim:

1. A coil spring assembly for mattresses and box springs characterized by improved comfort and support in which the coil spring assembly is formed of coil springs arranged in a plurality of lengthwise and crosswise extending rows and in which the coil springs consist of two sets of coil springs in which the coil springs of both sets are of the same size but in which the coil springs of one set are of lower gauge and greater stiffness than the coil springs of the other set with the outermost coil springs in each of the lengthwise and crosswise extending rows and in the middle rows extending lengthwise and crosswise of the spring assembly being of the one set while the coil springs remaining in the rows adjacent the outermost lengthwise rows being of the other set with the number of lengthwise rows of coil springs of the one set comprising at least half of the lengthwise rows of coil springs in the spring assembly.

* * * * *